US010125763B1

(12) United States Patent
St. James et al.

(10) Patent No.: US 10,125,763 B1
(45) Date of Patent: Nov. 13, 2018

(54) HEIGHT EXTENDED DRYWALL PUMP

(71) Applicant: Columbia Taping Tools, Ltd., Surrey (CA)

(72) Inventors: Elliot St. James, Surrey (CA); Aaron St. James, Surrey (CA)

(73) Assignee: Columbia Taping Tools, Ltd., Surrey (CA)

( * ) Notice: Subject to any disclaimer, the term of this patent is extended or adjusted under 35 U.S.C. 154(b) by 0 days.

(21) Appl. No.: 15/404,134

(22) Filed: Jan. 11, 2017

Related U.S. Application Data

(60) Provisional application No. 62/363,184, filed on Jul. 15, 2016, provisional application No. 62/277,151, filed on Jan. 11, 2016.

(51) Int. Cl.

| | |
|---|---|
| ***F04B 15/02*** | (2006.01) |
| ***F04B 53/16*** | (2006.01) |
| ***E04F 21/02*** | (2006.01) |
| ***F04B 9/14*** | (2006.01) |
| ***F04B 23/02*** | (2006.01) |
| ***F04B 53/14*** | (2006.01) |

(52) U.S. Cl.
CPC ..... *F04B 53/162* (2013.01); *E04F 21/02* (2013.01); *F04B 9/14* (2013.01); *F04B 15/02* (2013.01); *F04B 23/023* (2013.01); *F04B 53/144* (2013.01)

(58) Field of Classification Search
CPC ..... F04B 53/162; F04B 53/144; F04B 9/14; F04B 15/02; F04B 23/023; E04F 21/00; E04F 21/026
See application file for complete search history.

(56) References Cited

U.S. PATENT DOCUMENTS

| | | | | | |
|---|---|---|---|---|---|
| 1,076,488 | A * | 10/1913 | Deming | B05B 11/3015 | 222/385 |
| 2,889,857 | A * | 6/1959 | Ames | F04B 9/14 | 141/113 |
| 3,785,535 | A * | 1/1974 | Ames | F04B 7/0038 | 222/331 |
| 5,535,926 | A * | 7/1996 | Blitz | B05C 17/002 | 222/334 |
| 5,711,462 | A * | 1/1998 | Hard | B67D 7/0205 | 141/26 |
| 6,299,686 | B1 * | 10/2001 | Mills | F04B 43/10 | 118/207 |
| 2008/0292481 | A1 * | 11/2008 | Castagnetta, Jr. | F04B 9/14 | 417/437 |
| 2011/0189039 | A1 * | 8/2011 | Roman | A61M 1/00 | 417/437 |

* cited by examiner

*Primary Examiner* — Nicholas J Weiss
(74) *Attorney, Agent, or Firm* — Schacht Law Office, Inc.; Dwayne Rogge

(57) ABSTRACT

This disclosure relates to the field of drywall mud pumps and a bracket to facilitate use of an extended height (taller) drywall pump in a drywall mud bucket. A support system removably coupled to the upper edge of a bucket containing drywall mud supports a drywall pump which extends vertically well above the upper edge of the bucket.

9 Claims, 8 Drawing Sheets

HEIGHT EXTENDED DRYWALL PUMP

RELATED APPLICATIONS

This application claims priority benefit of U.S. Ser. No. 62/277,151, filed Jan. 11, 2016, incorporated herein by reference. This application also claims priority benefit of U.S. Ser. No. 62/363,184, filed Jul. 15, 2016, incorporated herein by reference.

BACKGROUND OF THE DISCLOSURE

Field of the Disclosure

This disclosure relates to the field of drywall mud pumps and a bracket to allow use of an extended height drywall pump in a standard or tall drywall mud bucket.

BRIEF SUMMARY OF THE DISCLOSURE

A Height Extended Drywall Pump is disclosed herein. In one example the pump comprises: a pump assembly comprising; a plunger housing having an upper end and a lower end with a height measured from the upper end to the lower end; a plunger rod having an upper end and a lower end within the plunger housing; a pump handle having a median portion pivotably attached to the upper end of the plunger housing; the pump handle having a first end attached to the upper end of the plunger rod and a second end comprising a grasping portion; a drywall mud bucket having a bottom edge resting on the ground, an upper edge with inner and outer surfaces, a height measured from the bottom edge to the upper edge. The pump in one form utilizes a support assembly comprising; a support stand having an upper end attached to the upper end of the pump assembly and a lower end resting on the ground; surfaces defining a plurality of elongated voids though the support stand; a support bracket attached to the support stand via the elongated voids and in contact with the upper inner and outer surfaces of the upper edge of the drywall mud bucket; and wherein the height of the plunger housing is greater than the height of the drywall mud bucket.

The Height Extended Drywall Pump as recited above may be arranged wherein the height of the plunger housing is at least 120% greater than the height of the drywall mud bucket.

The Height Extended Drywall Pump as recited above may be arranged wherein the height of the plunger housing is at least 150% greater than the height of the drywall mud bucket.

The Height Extended Drywall Pump as recited above may be arranged wherein the height of the plunger housing is at least 200% the height of the drywall mud bucket.

The Height Extended Drywall Pump may be arranged wherein the support bracket is substantially wider than the support stand.

The Height Extended Drywall Pump may be arranged wherein the support bracket horizontally surrounds the support stand.

The Height Extended Drywall Pump may be arranged wherein the support stand comprises surfaces defining a plurality of vertically elongated voids though the support stand; wherein the support bracket is attached to the support stand via the elongated voids.

The Height Extended Drywall Pump may be arranged wherein the support stand comprises surfaces defining horizontally projecting wings that engage wing surfaces on the support bracket to prohibit rotation of the support bracket relative to the support stand.

DETAILED DESCRIPTION OF THE DISCLOSURE

Figure 1:
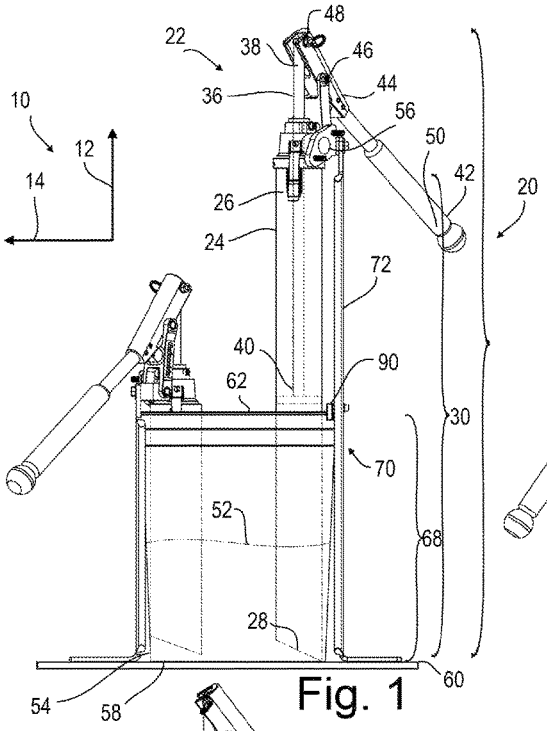
FIG. 1 is a front cutaway view of a prior art drywall pump and one example of a height extended (taller) drywall pump positioned in the same drywall mud bucket.
Figure 2:
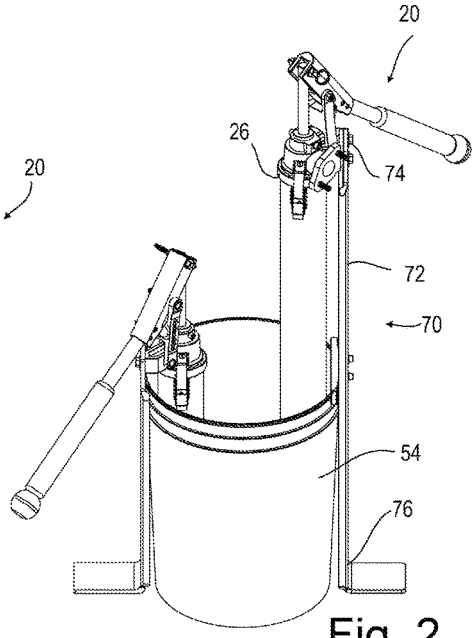
FIG. 2 is a top isometric view of the example shown in FIG. 1.

Disclosed herein is a Height Extended Drywall Pump 20 having a plunger housing height significantly taller than the inner wall height of a bucket into which the pump 20 is placed. In one example the pump 20 includes a pump assembly 22 having a plunger housing 24 with an upper end 26 and a lower end 28 with a plunger housing height 30 measured from the upper end 26 to the lower end 28; a plunger rod 36 having an upper end 38 and a lower end 40 within the plunger housing 24. To actuate the plunger rod, a pump handle 42 having a median portion 44 is pivotably attached to the upper end 26 of the plunger housing 24 at a handle pivot 46.

Figure 4:
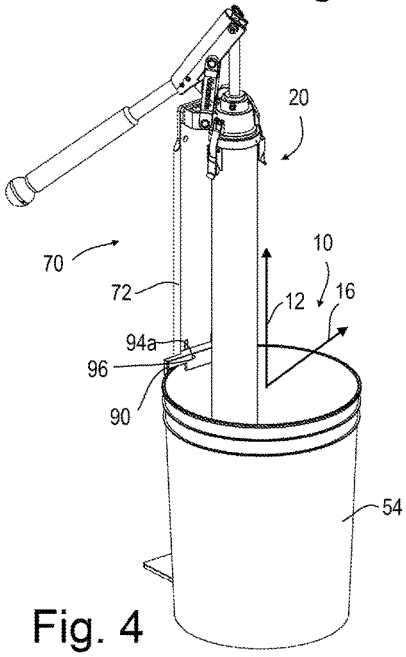
FIG. 4 is a front isometric view of the example height extended drywall pump shown in FIG. 1.
Figure 5:
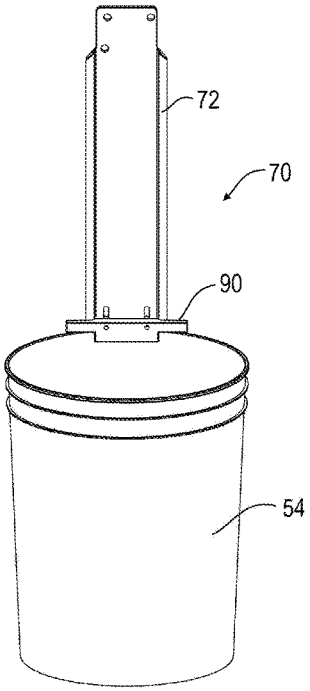
FIG. 5 is a front isometric view of several components of the example height extended drywall pump shown in FIG. 1.
Figure 6:
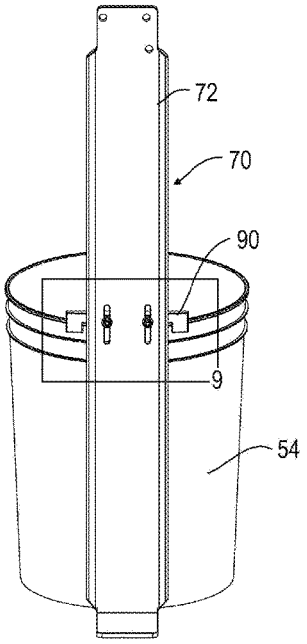
FIG. 6 is a rear isometric view of the example height extended drywall pump shown in FIG. 5.
Figure 7:
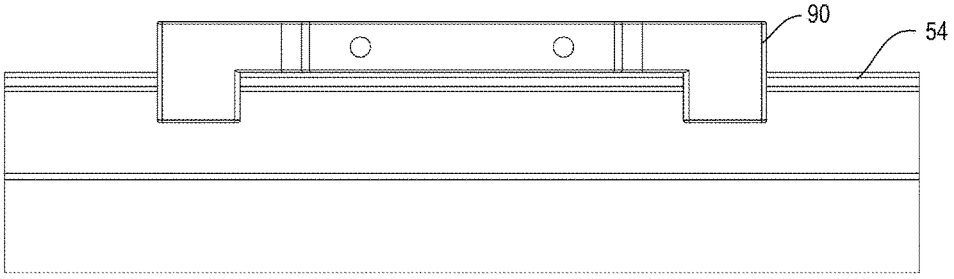
FIG. 7 is a front view of a bracket component of the example height extended drywall pump shown in FIG. 1.
Figure 8:
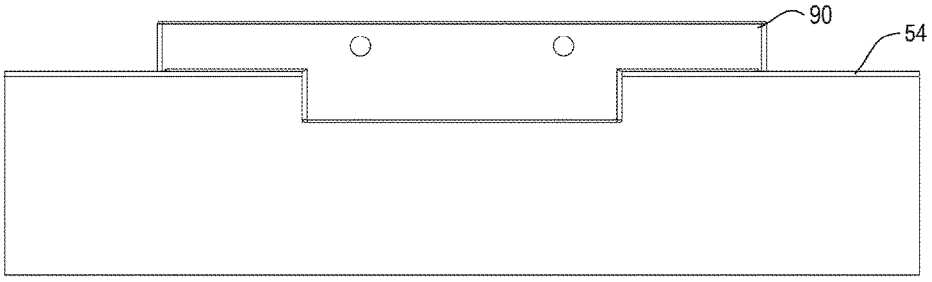
FIG. 8 is a rear view of the component shown in FIG. 7.
Figure 9:
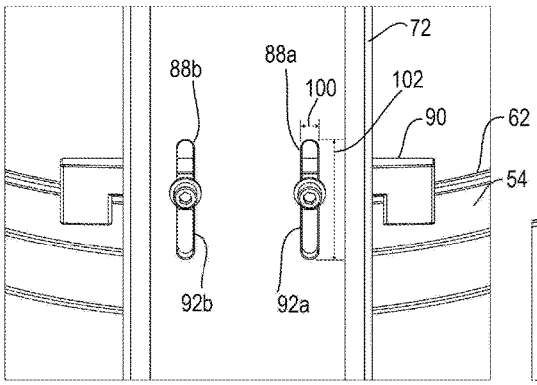
FIG. 9 is an enlarged view of the area 9 shown in FIG. 6.

Before continuing a detailed description of the examples shown herein, an axes system 10 is disclosed comprising a vertical axis 12 and a horizontal axis 14. Also disclosed is a radial axis 16 extending as shown in the example of FIG. 4 from the center of the cylindrical bucket.

In one example the pump handle 42 has a first end 48 pivotably attached to the upper end 38 of the plunger rod 36 and a second end 50 forming a grasping portion. The grasping portion is held by a user and the pump handle 42 is vertically articulated to pump drywall mud compound 52 or similar fluids. The term drywall mud used herein to cover such fluid materials, viscous materials, and equivalents.

When in use, the lower end 28 of the pump assembly 22 extends vertically down into a bucket 54 to pump drywall mud 52 through the plunger housing 24 to a pump assembly outlet 56. The (drywall mud) bucket 54 has a bottom edge 58 resting on the ground 60, an upper edge 62 with inner 64 and outer 66 surfaces. A bucket height 68 is measured from the bottom edge 58 to the upper edge 62.

Figure 30:
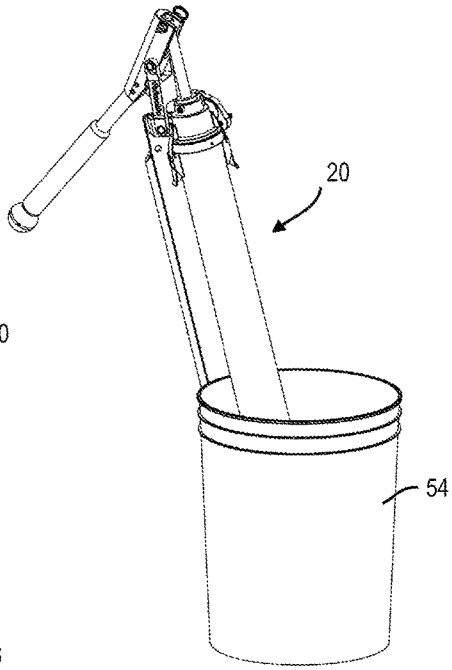
FIG. 30 is a front isometric view of one example of a drywall mud pump installed in a bucket without the disclosed bracket system.

To keep the height extended drywall pump 20 from skewing (rotating, twisting) as shown in FIG. 30, a support assembly 70 is provided. The support assembly 70 in one example comprising; a support stand 72 having an upper end 74 attached to the upper end 26 of the pump assembly and a lower end 76 resting on the ground 60 eternal of the bucket 54. In example shown, the lower end 76 of the support stand 72 comprises a foot 78 attached to a vertical extension portion 80 via an angle 82 which may be formed by bending the foot 78 relative to the vertical extension 80, or may be formed by welding, adhering, or otherwise fastening the foot 78 to the vertical extension 80. In use, a user will generally press their foot downwards upon the upper surface 84 of the foot 78 pressing the lower surface 86 against the ground 60. this additional pressure adding stability to the overall support stand 72 and attached pump assembly 22 as the user grasps the grasping portion 50 of the pump handle 42 and vertically oscillates the handle 42 about the handle pivot 46 top operate the device and pump mud or other (viscous) liquids from the bucket 54 to the pump assembly outlet 56.

To further secure the height extended drywall pump 20 to the upper (top) edge 62 of the bucket 54 and prevent skewing, surfaces defining a plurality of elongated voids 88 (i.e. voids 88*a*, 88*b*) may be provided though the support stand 72 for vertically movable attachment of a support bracket 90. The support bracket 90 attaches to the support stand 72 via fasteners passing through the elongate (longer in the vertical dimension than in the horizontal dimension) voids 88. The support bracket 90 of one example is in contact with (clamps onto) the inner 64 and outer 66 surfaces of the upper edge 62 of the drywall mud bucket 54 to stabilize the support assembly 70 in use.

These components are particularly useful when the height 30 of the plunger housing 24 is greater than the height 68 of the drywall mud bucket 54.

Figure 3:
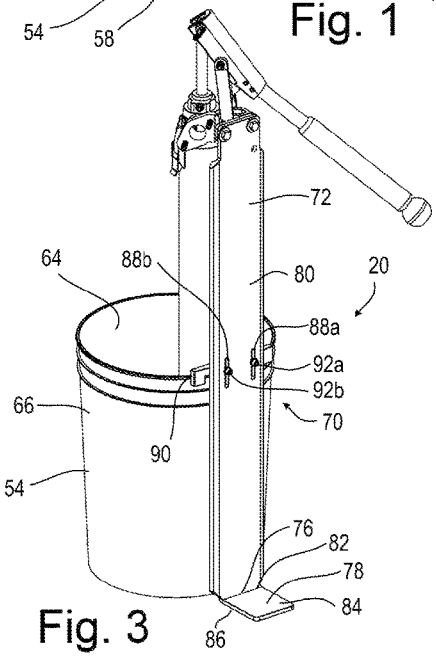
FIG. 3 is a rear isometric view of the example height extended drywall pump shown in FIG. 1.

Looking to FIG. 3 it can be seen that a plurality of fasteners 92*a* and 92*b* pass through the voids 88*a* and 88*b* and are either threaded into surfaces defining threaded voids 94*b* and 94*a* respectively in the support bracket 90 or optionally threaded into a nut 96 or equivalent apparatus. As the head 98 of the fastener 92 is larger than the width 100 of these voids 88, as the fastener is tensioned against the support stand 72 at the desired height, the support bracket 90 is secured in the desired position and may provide a clamping force against this portion of the bucket 54. As the height 102 of the void 88 is substantially larger, vertical adjustment of the bracket 90 relative to the top edge 62 of the bucket 54 is permitted prior to tensioning of the fasteners 88.

Figure 10:
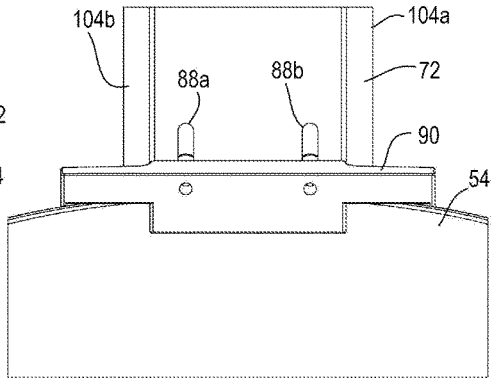
FIG. 10 is a front view of the area shown in FIG. 9.
Figure 11:
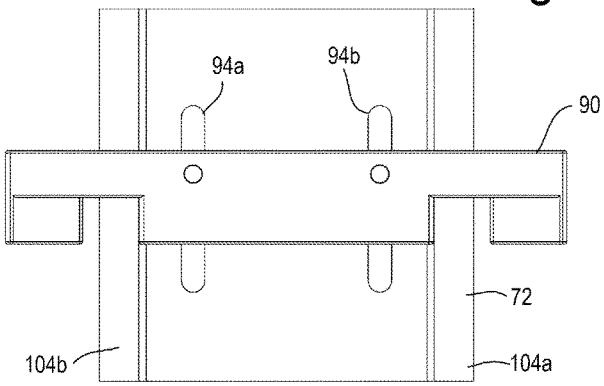
FIG. 11 shows the components shown in FIG. 10 removed from the drywall mud bucket.
Figure 12:
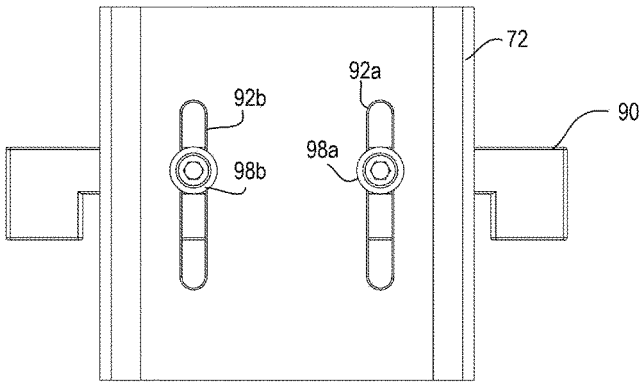
FIG. 12 shows the components shown in FIG. 9 removed from the drywall mud bucket.
Figure 13:
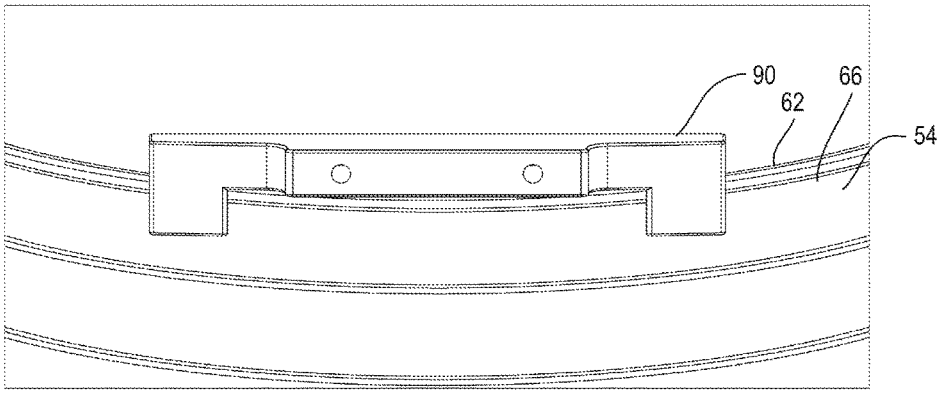
FIG. 13 shows several components of FIG. 9 with the support stand removed to show the remaining components.
Figure 14:
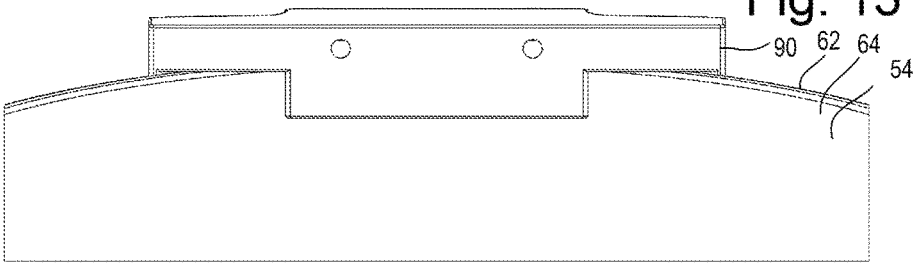
FIG. 14 is a front isometric view of the components shown in FIG. 13.
Figure 15:
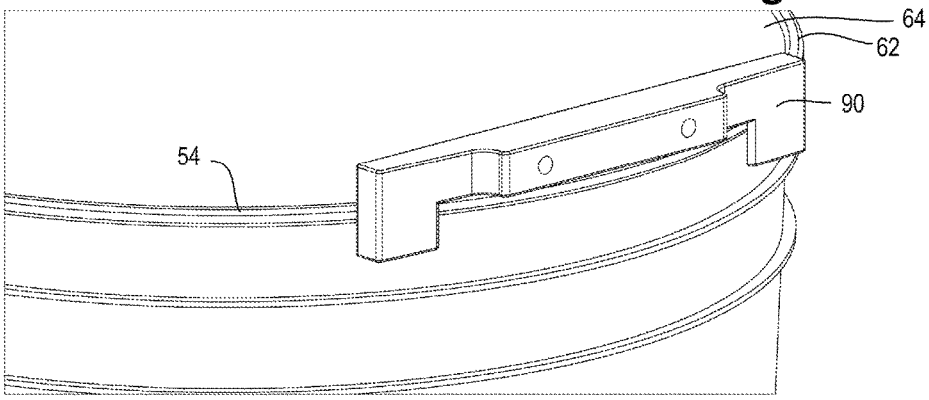
FIG. 15 is a side isometric view of the components shown in FIG. 13.
Figure 16:
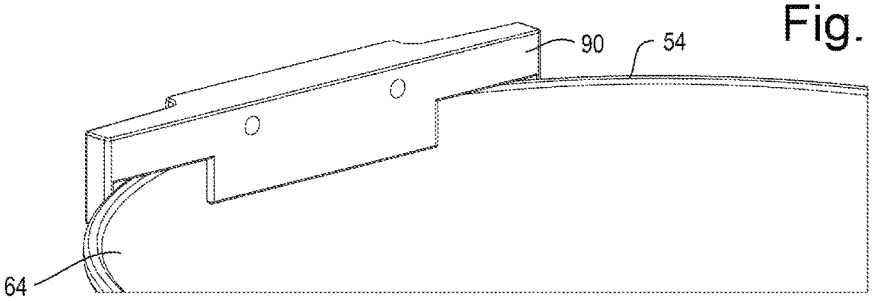
FIG. 16 is an opposing side isometric view of the components shown in FIG. 15.
Figure 17:
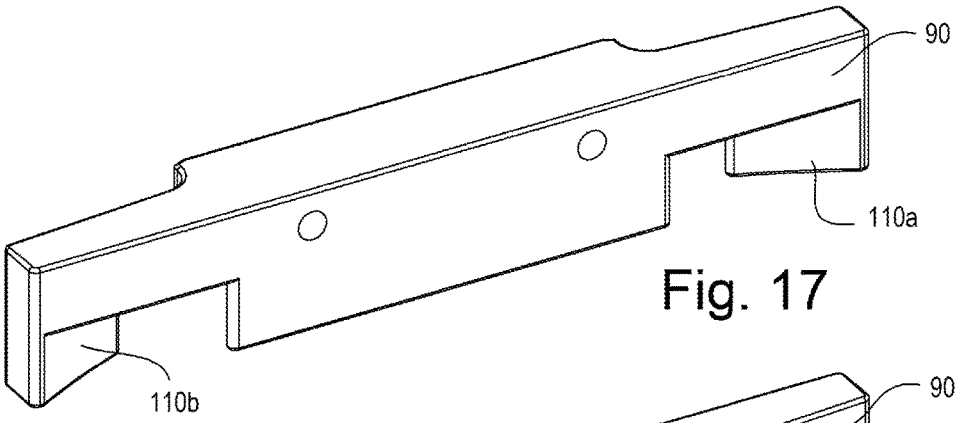
FIG. 17 shows the bracket component of FIG. 16 removed from the drywall mud bucket.
Figure 18:
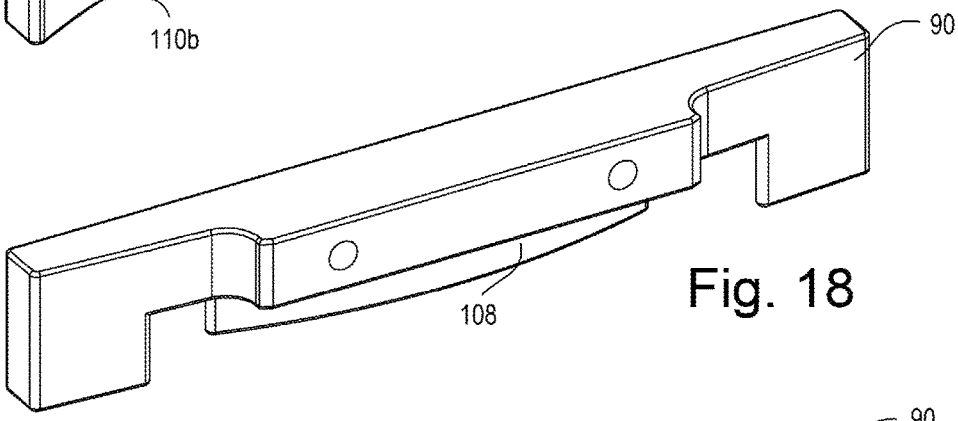
FIG. 18 shows the bracket component of FIG. 15 removed from the drywall mud bucket.
Figure 19:
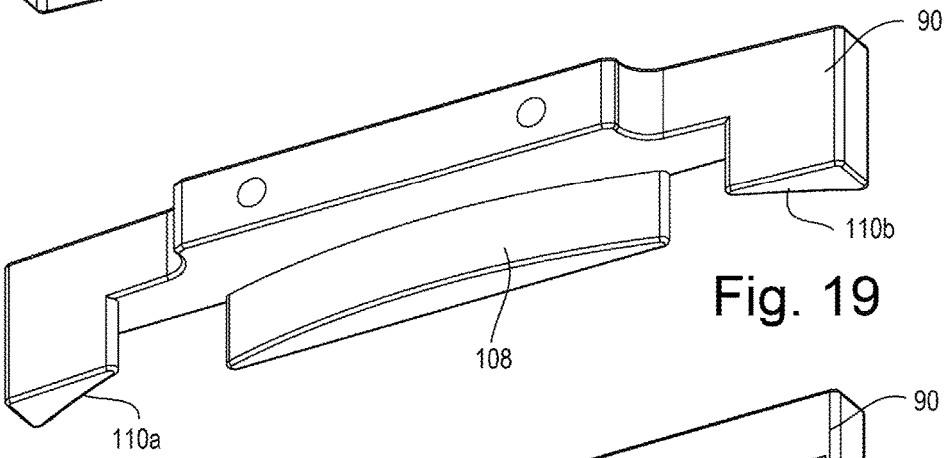
FIG. 19 is a rear bottom isometric view of the bracket component shown in FIG. 15.
Figure 20:
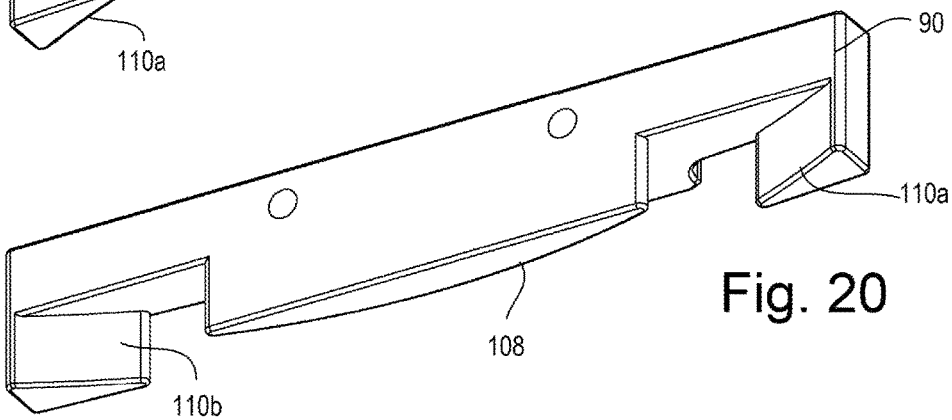
FIG. 20 is a front bottom isometric view of the bracket component shown in FIG. 15.
Figure 21:
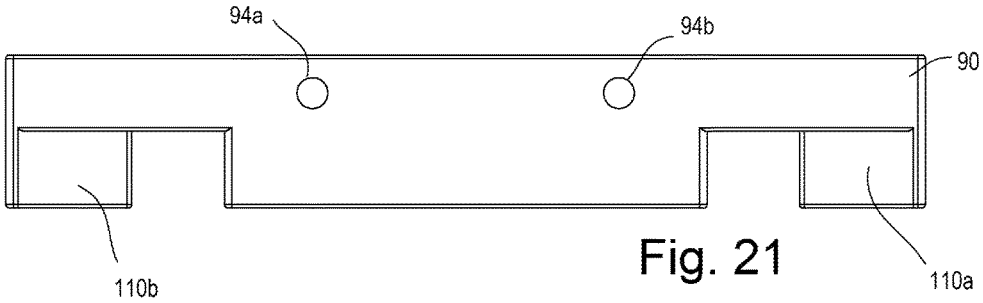
FIG. 21 is a front view of the bracket component shown in FIG. 15.
Figure 22:
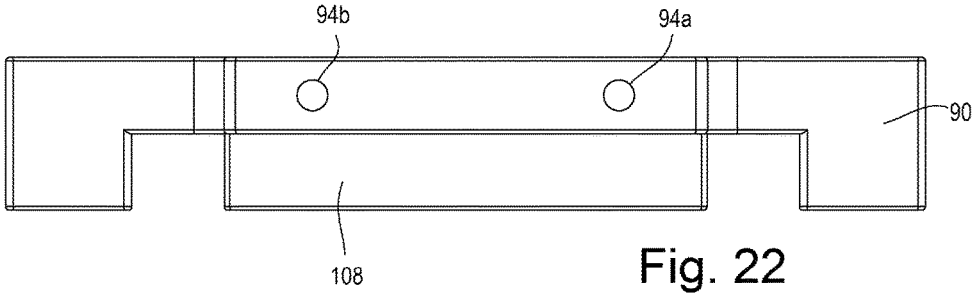
FIG. 22 is a rear view of the bracket component shown in FIG. 15.
Figure 23:
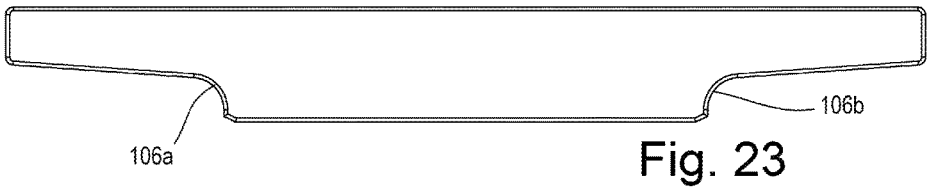
FIG. 23 is a top view of the bracket component shown in FIG. 15.

Looking to FIG. 10 is shown an example where in the support stand 72 comprises a plurality of radially inward projecting wings 104*a* and 104*b*. These wings 104 provide rigidity against bending of the support stand 72 and additionally provide resistance against rotation of the support bracket 90. In the example shown for example in FIG. 23 a wing contact surface 106*a* and 106*b* of the bracket 90 is provided in contact with each of the associated wings 104 of the support stand 72 to reduce skewing of the drywall pump 20 in use.

Figure 24:
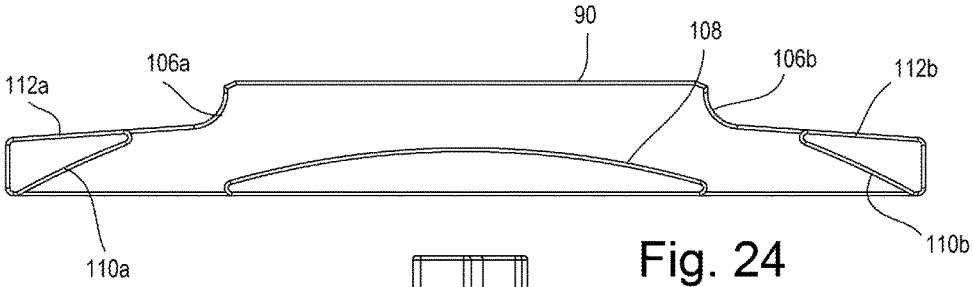
FIG. 24 is a bottom view of the bracket component shown in FIG. 15.
Figure 25:
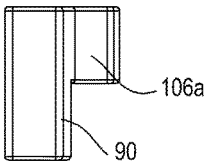
FIG. 25 is an end view of the bracket component shown in FIG. 15.
Figure 26:
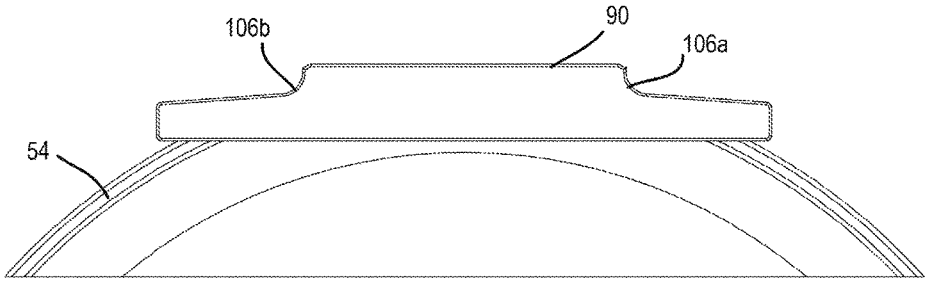
FIG. 26 is a top view of the bracket component shown in FIG. 15 attached to a drywall mud bucket.
Figure 27:
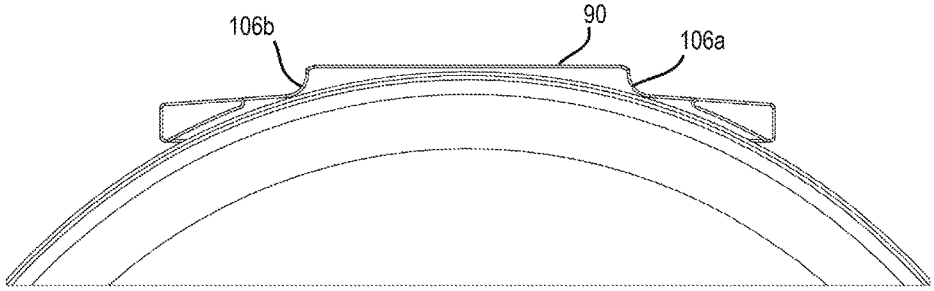
FIG. 27 is a bottom view of the bracket component shown in FIG. 15 attached to a drywall mud bucket.
Figure 28:
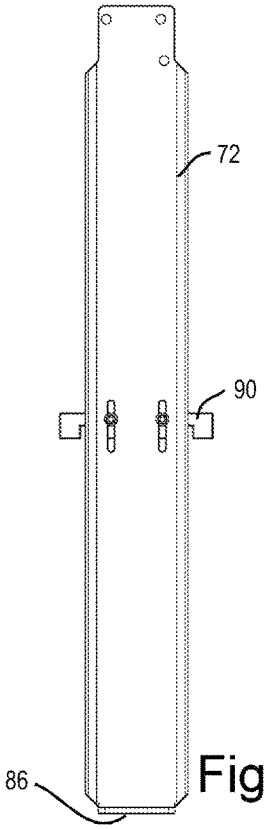
FIG. 28 is a rear view of the bracket component shown in FIG. 15 attached to one example of a support stand.
Figure 29:
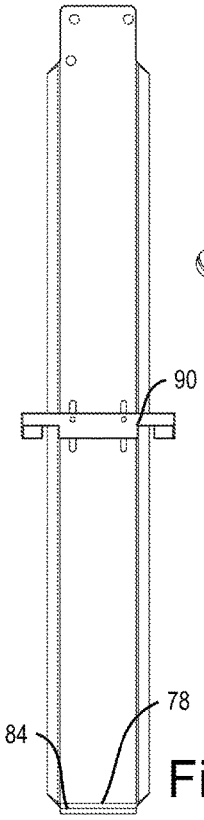
FIG. 29 is a front view of the components shown in FIG. 28.

In addition, looking to FIG. 24 it can be seen in the bottom view that a convex surface 108 may be provided on the bracket 90. The convex surface 108 having a radius substantially equivalent to the inner surface 64 of the bucket 54 so as to provide additional contact (clamping force) against surfaces of the bucket 54 and prohibit rotation. FIG. 24 shows a plurality of concave surfaces 110*a* and 110*b* on the bracket 90. The convex surfaces 110 having a radius substantially equivalent to the outer surface 66 of the bucket 54 so as to provide additional contact (clamping force) against the surfaces of the bucket 54 and thus prohibit rotation of the drywall pump 20 relative to the bucket 54. In addition, in one example the concave surfaces 110 as shown are provided on projections 112 extending circumferentially or horizontally outward from the surfaces 106 so as to further prohibit rotation (skewing) of the apparatus as shown in FIG. 30.

Figure 34:
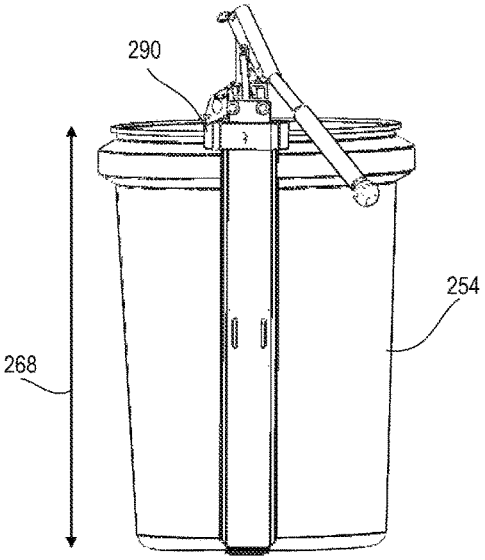
FIG. 34 is a rear view of the bracket shown in FIG. 31 attached to a larger (taller and wider) standard 33-55 gallon style bucket (trashcan).

Looking to FIG. 34 is shown a variation 290 of the bracket 90 disclosed above. This variation 290 is shown attached to a taller bucket than shown in the examples of FIG. 1-30. The bucket shown in FIG. 1-30 has a volume commonly in the 3-7 gallon range and has a bucket height 68 often between 10-27 inches. The bucket 254 as shown in FIG. 34 often has a volume commonly in the 20-55 gallon range and a bucket height 268 between 24 and 40 inches. Such buckets (or barrels) are often known as Hamilton barrels.

Figure 31:
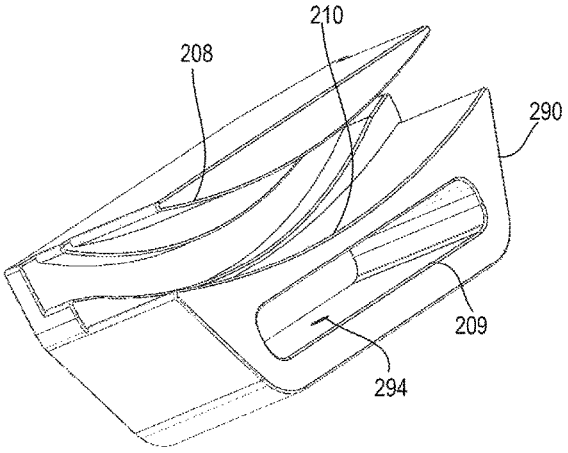
FIG. 31 is a bottom isometric view of another example of the bracket component shown in FIG. 15.
Figure 32:
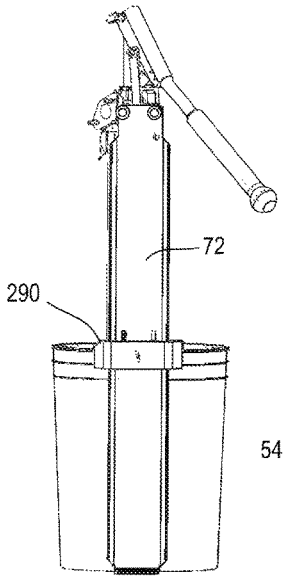
FIG. 32 is a rear view of the bracket shown in FIG. 31 attached to a standard 3-7 gallon style bucket.
Figure 33:
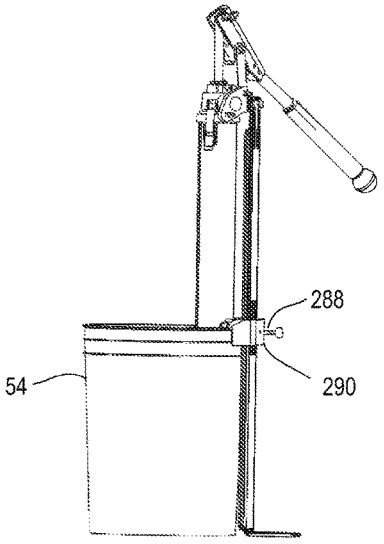
FIG. 33 is a side view of the example shown in FIG. 31.

Looking to FIG. 31 is shown the bracket variation 290 where a surface 209 surrounds and contacts the outer surface of the support stand 72 in sliding contact thereto. In one example, a fastener 288 such as a wing bolt, threads through a threaded female surface 294 and when tensioned, presses against the outer surface of the support stand 72 and maintains position of (clamps) the bracket 254 on the support stand 72.

The variation of the bracket 290 shown in FIG. 31 has a concave surface 210 which engages the outer surface of the bucket 54 or 254 and a convex surface 208 which engages the inner surface of the bucket 54 or 254.

This arrangement and securing method allows for different mounting positions than that disclosed above relative to the bracket shown in FIGS. 7-30.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

The invention claimed is:

1. A Height Extended Drywall Pump comprising:

a pump assembly comprising;

a plunger housing having an upper end and a lower end with a plunger housing height measured from the upper end of the plunger housing to the lower end of the plunger housing;

a plunger rod having an upper end, and a lower end within the plunger housing;

a pump handle having a median portion pivotably attached to the upper end of the plunger housing;

the pump handle having a first end attached to the upper end of the plunger rod and a second end comprising a grasping portion;

the pump assembly configured to partially fit within a drywall mud bucket having a bottom edge resting on the ground, an upper edge with an upper inner surface and an upper outer surface, an inner wall height measured from the bottom edge to the upper edge;

a support assembly comprising;

a support stand having an upper end attached to the pump assembly and a lower end resting on the ground;

a support bracket attached to the support stand so as to be vertically repositionable on the support stand;

the support bracket configured to be in contact with the upper inner surface and upper outer surface of the upper edge of the drywall mud bucket; and wherein the height of the plunger housing is configured to be greater than the inner wall height of the drywall mud bucket.

2. The Height Extended Drywall Pump as recited in claim 1 wherein the height of the plunger housing is configured to be at least 120% of the height of the drywall mud bucket.

3. The Height Extended Drywall Pump as recited in claim 1 wherein the height of the plunger housing is configured to be at least 150% of the height of the drywall mud bucket.

4. The Height Extended Drywall Pump as recited in claim 1 wherein the height of the plunger housing is configured to be at least 200% of the height of the drywall mud bucket.

5. The Height Extended Drywall Pump as recited in claim 1 wherein the support bracket is substantially wider than the support stand.

6. The Height Extended Drywall Pump as recited in claim 1 wherein the support stand comprises surfaces defining a plurality of vertically elongated voids through the support stand; wherein the support bracket is attached to the support stand via the elongated voids.

7. The Height Extended Drywall Pump Support Assembly as recited in claim 1, the support bracket further comprising:

a concave surface configured to engage an outer surface of the drywall mud bucket; and a convex surface configured to engage an inner surface of the bucket.

8. A Height Extended Drywall Pump comprising:

a pump assembly comprising;

a plunger housing having an upper end and a lower end with a plunger housing height measured from the upper end of the plunger housing to the lower end of the plunger housing;

a plunger rod having an upper end, and a lower end within the plunger housing;

a pump handle having a median portion pivotably attached to the upper end of the plunger housing;

the pump handle having a first end attached to the upper end of the plunger rod and a second end comprising a grasping portion;

the pump assembly configured to partially fit within a drywall mud bucket having a bottom edge resting on the ground, an upper edge with an upper inner surface and an upper outer surface, an inner wall height measured from the bottom edge to the upper edge;

a support assembly comprising;

a support stand having an upper end configured to be attached to the pump assembly and a lower end resting on the ground;

a support bracket attached to the support stand so as to be vertically repositionable on the support stand;

the support bracket configured to be in contact with the upper inner surface and upper outer surface of the upper edge of the drywall mud bucket;

wherein the height of the plunger housing is configured to be greater than the inner wall height of the drywall mud bucket; and wherein the support bracket horizontally surrounds the support stand.

9. A Height Extended Drywall Pump comprising:

a pump assembly comprising;

a plunger housing having an upper end and a lower end with a plunger housing height measured from the upper end of the plunger housing to the lower end of the plunger housing;

a plunger rod having an upper end, and a lower end within the plunger housing;

a pump handle having a median portion pivotably attached to the upper end of the plunger housing;

the pump handle having a first end attached to the upper end of the plunger rod and a second end comprising a grasping portion;

the pump assembly configured to partially fit within a drywall mud bucket having a bottom edge resting on the ground, an upper edge with an upper inner surface and an upper outer surface, an inner wall height measured from the bottom edge to the upper edge;

a support assembly comprising;

a support stand having an upper end attached to the pump assembly and a lower end resting on the ground;

a support bracket attached to the support stand so as to be vertically repositionable on the support stand;

the support bracket configured to be in contact with the upper inner surface and upper outer surface of the upper edge of the drywall mud bucket;

wherein the height of the plunger housing is configured to be greater than the inner wall height of the drywall mud bucket; and wherein the support stand comprises surfaces defining horizontally projecting wings that engage wing surfaces on the support bracket to prohibit rotation of the support bracket relative to the support stand.

* * * * *